US010726665B2

(12) United States Patent
Martineck, Sr. et al.

(10) Patent No.: US 10,726,665 B2
(45) Date of Patent: Jul. 28, 2020

(54) MULTI-LINGUAL ENABLED SCRATCH-OFF LOTTERY TICKET SYSTEM AND METHOD

(71) Applicant: Scientific Games International, Inc., Newark, DE (US)

(72) Inventors: Jeffrey D. Martineck, Sr., Johns Creek, GA (US); Russ Joiner, Chamblee, GA (US)

(73) Assignee: Scientific Games International, Inc., Newark, DE (US)

( * ) Notice: Subject to any disclaimer, the term of this patent is extended or adjusted under 35 U.S.C. 154(b) by 204 days.

(21) Appl. No.: 15/958,124

(22) Filed: Apr. 20, 2018

(65) Prior Publication Data

US 2019/0325697 A1 Oct. 24, 2019

(51) Int. Cl.
*G07F 17/32* (2006.01)

(52) U.S. Cl.
CPC ..... *G07F 17/3227* (2013.01); *G07F 17/323* (2013.01); *G07F 17/3223* (2013.01); *G07F 17/329* (2013.01)

(58) Field of Classification Search
CPC ..... G07F 17/329; G06F 16/3337
See application file for complete search history.

(56) References Cited

U.S. PATENT DOCUMENTS 3,918,174 A 11/1975 Miller et al.
4,734,036 A 3/1988 Kasha
7,590,950 B2 9/2009 Collins et al.
8,434,792 B2 5/2013 Martineck, Sr.
9,424,252 B2 * 8/2016 Takaoka ..... G06F 17/289
2003/0181235 A1 * 9/2003 Bennett, III ..... G06Q 20/3437 463/17
2005/0130736 A1 6/2005 Polak et al.
2006/0020928 A1 * 1/2006 Holloway ..... G06F 9/454 717/136
2009/0017893 A1 * 1/2009 Carson ..... G07F 17/329 463/17
2009/0287471 A1 * 11/2009 Bennett ..... G06F 17/275 704/3
2010/0069136 A1 3/2010 Safaei et al.
2014/0045568 A1 2/2014 Bennett, III et al.
2016/0203126 A1 * 7/2016 Zhu ..... G06F 16/338 704/3

OTHER PUBLICATIONS

EPO Search Report, dated Aug. 19, 2019.

* cited by examiner

*Primary Examiner* — Omkar A Deodhar
*Assistant Examiner* — Ross A Williams
(74) *Attorney, Agent, or Firm* — Dority & Manning, P.A.

(57) ABSTRACT

An instant lottery ticket game system and method wherein a set of master instant lottery tickets includes instruction indicia printed in a master language and a ticket-specific code. For each of the master tickets, corresponding digital lottery tickets are saved in a file and include the instruction indicia in a foreign language, wherein the ticket-specific code on each master ticket links to the file associated with the master ticket. A game server is in communication with the files and is configured for communication with a player's smart device via an application downloaded to the smart device. Via the application, the player enters the ticket-specific code from the master ticket and is presented with an option to receive one or more of the foreign language digital lottery tickets transmitted to their smart device.

18 Claims, 5 Drawing Sheets

MULTI-LINGUAL ENABLED SCRATCH-OFF LOTTERY TICKET SYSTEM AND METHOD

FIELD OF THE INVENTION

The present invention generally relates to a system and method for implementing a scratch-off ("instant") lottery ticket game, and more particularly to a method and system for facilitating multi-lingual play of such games.

BACKGROUND

"Scratch-off" or "instant-win" lottery tickets have enjoyed immense popularity in the lottery industry for decades. These games offer distinct advantages to the lottery authorities and are attractive to a broad spectrum of players. Typically, the tickets are printed in the primary language of a targeted population base. For example, the same themed ticket may be printed in different runs in English, Spanish, German, and so forth, depending on the intended country or other distribution locale.

However, as the population base grows more culturally diverse, particularly in larger metropolitan areas, one single language may no longer be dominant over a broad population spectrum. Entire sections or neighborhoods of a city or other locale may speak one language, while an adjacent neighborhood may primarily speak an entirely different language. The residents of these neighborhoods may not be comfortable with the other respective language. This pertains to play of lottery tickets in differing languages as well. Persons who are not fluent or comfortable with the language of the scratch-off ("instant") lottery ticket may avoid playing the game for fear of not understanding the game rules or, even worse, not recognizing that their ticket may actually be a winning ticket. As the games continue to add greater prizes and more complex entertainment features, the reluctance to play the game by those not comfortable with the language of the ticket will correspondingly grow.

In the past, it has not been economically or commercially feasible to provide a multi-lingual game card or lottery ticket. The available surface area on a scratch-off ticket (often referred to as the ticket "real estate") for the various game features, such as a game play area, instructions, security features, graphics, and so forth, is limited and cannot reasonably accommodate repetition of the pertinent game rules or instructions in different languages. Essentially, the only option was to provide separate production runs of tickets in the different languages.

U.S. Pat. No. 8,434,792 proposes a solution wherein a game on a single paper game card includes a game play area, and a first set of game instructions provided on the game card printed in a first language. A second set of the game instructions in a second different printed language is superimposed over the first set of game instructions. An indicator is provided on the game card to convey that the first set of game instructions are present and accessible by removing the second set of game instructions. Thus, the player has the option to read the game instructions in either or both of the first or second printed languages. Although this is a useful method and system, it requires substantial additional printing time, expenses, and materials.

The industry and public would benefit from still more improved methods to facilitate multi-lingual play of a game on a printed game card, such as a scratch-off lottery ticket.

SUMMARY

Objects and advantages of the invention will be set forth in part in the following description, or may be obvious from the description, or may be learned through practice of the invention.

In a particular embodiment, an instant lottery ticket game system and associated method are provided wherein a set of master instant lottery tickets are produced with instruction indicia printed in a master language. The master instant lottery tickets may be printed paper tickets, or may be electronically simulated tickets that are transmitted to and played by the player via an application running on a smart device, such as a mobile phone, tablet, computer, etc. Each of the master instant lottery tickets includes a ticket-specific code printed thereon, such as a scannable barcode or alphanumeric code. For each master instant lottery ticket, one or more corresponding digital lottery tickets is generated and saved in a computer-accessible file associated with the master instant lottery ticket. Each of these digital lottery tickets includes the instruction indicia in a foreign language. For example, a master instant lottery ticket may be printed with the instruction indicia in English. Four different corresponding digital lottery tickets may be generated and stored, wherein the digital tickets are in Spanish, French, German, and Italian.

It should be appreciated that the term "master language" in used herein to refer to the language of the primary printed or electronic ticket master ticket, and is not limited to any particular language. The term "foreign language" is used herein to refer to any language that is different than the master language.

The ticket-specific code on each of the master instant lottery tickets is linked to the file associated with the master instant lottery ticket, wherein a game server is configured in communication with the files in order to retrieve the files. The server is also configured for communication with a player's smart device via a computer application downloaded to the player's smart device.

With the above system and method, the player enters the ticket-specific code from a purchased master instant lottery ticket via the application on their smart device. Upon receipt of the code, the game server retrieves one or more of the corresponding foreign language digital tickets selected by the player and transmits such ticket(s) to the player's smart device.

In a particular embodiment of the game system and method, each of the master instant lottery tickets further includes game play indicia in the master language, wherein such game play indicia is the "variable" indicia that changes from one ticket to another and indicates whether the ticket is a winning or losing ticket. In these embodiments, the digital lottery tickets may also include the game play indicia in the foreign language.

In certain embodiments, the ticket-specific code on each of the master instant lottery tickets is the validation code that is liked to a validation file associated with the master instant lottery ticket and accessible by the central server. Those skilled in the art appreciate that the validation file contains ticket-specific information for validation and pay-out (redemption) of the master instant lottery ticket. In order to link the digital lottery tickets to the specific master instant lottery ticket and use the validation code, the digital lottery tickets associated with the master instant lottery ticket can be saved in the validation file.

However, in an alternative embodiment, the ticket-specific code on each of the master instant lottery tickets may be separate from the validation code and the digital lottery tickets stored separate from the validation file and accessible by the central server.

The validation file may also be provided with the digital lottery ticket, wherein it is thus enabled that the player is able to present either of the master instant lottery ticket or the digital lottery ticket for validation and redemption of a winning game play.

The digital lottery tickets may be presented as non-interactive static images on the player's smart device. For example, the image may simply present a "picture" of the ticket in the foreign language without the option or ability for the player to interact with or change the image.

However, in an alternate embodiment, the digital lottery tickets may be presented as interactive images on the player's smart device, wherein the app on the smart device is configured to allow the player to simulate play of the digital lottery ticket on their smart device, for example by simulating removal of the scratch-off coating from the game indicia to reveal the winning or losing status of the ticket. Thus, in this embodiment, the player can actually play the ticket on their smart device using the foreign language digital ticket without subsequent interaction with the master instant lottery ticket.

The system and method also contemplate that each of the master instant lottery tickets may be specifically configured to include an easily recognized symbol printed thereon that indicates to players that one or more of the foreign language digital lottery tickets is available for the master instant lottery ticket. For example, such symbol may be a multi-national caricature similar to the Olympic games characters and mascots.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Generally, the present disclosure is directed to a computer-based instant lottery ticket game system and associated method that enable multi-language play of a master ticket without printing various foreign language tickets or producing the master tickets with expensive additional printing layers or techniques. The system and method should have appeal to players for its ease of operation and foreign language versatility.

In a particular embodiment depicted in the figures, an instant lottery ticket game system 10 (FIG. 3) and associated method 100 (FIG. 4) are provided wherein a set 12 of individual master instant lottery tickets 14 are produced. Those skilled in the art appreciate that a set 12 of such tickets may be the entire lot (produced over the course of one or more production runs) for a given common game, wherein the prize structure that generates the expected value for the game is embodied by winning tickets distributed throughout the ticket lot. In other embodiments, the set 12 may be a subset of the entire lot of tickets for the game.

Figure 1A:
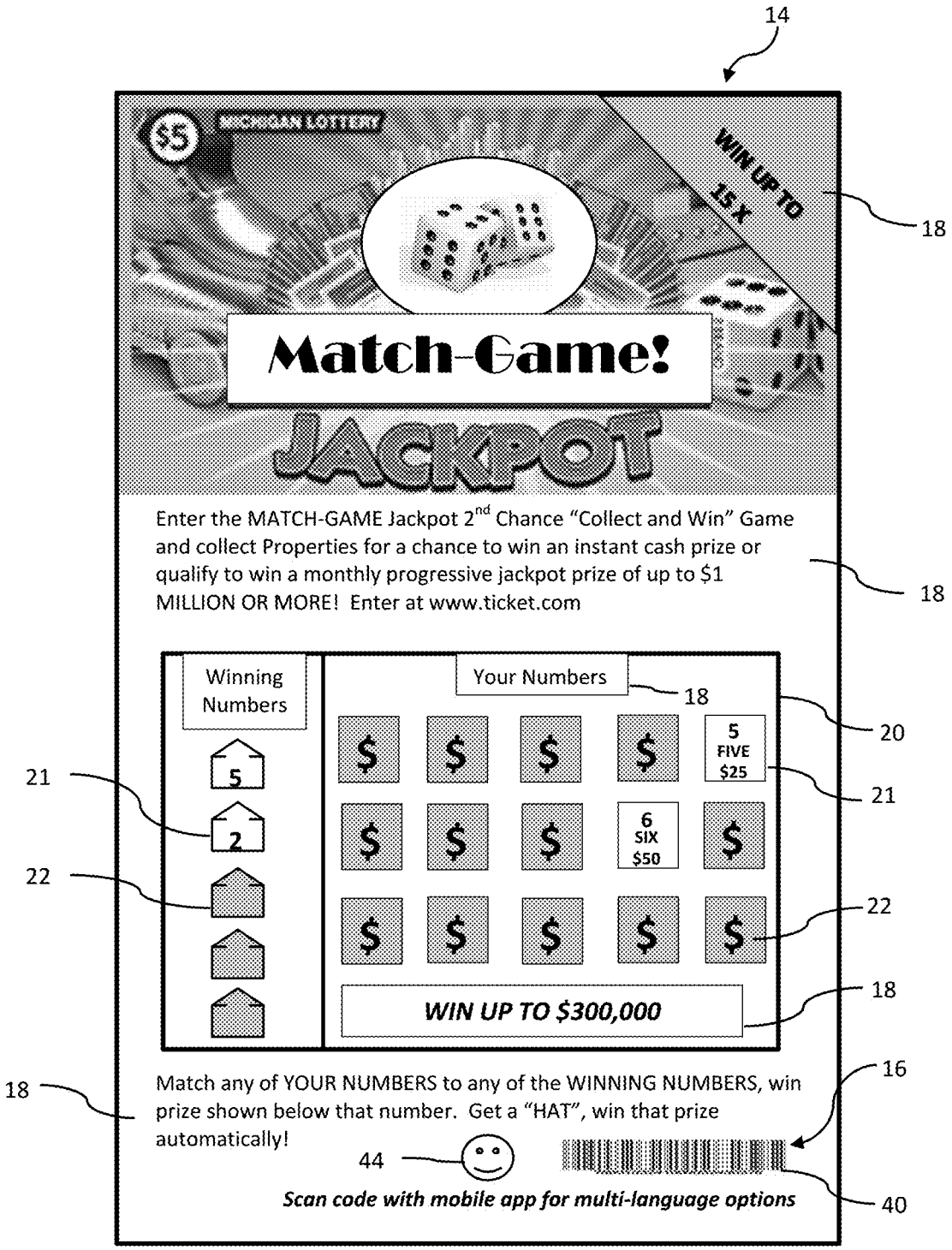
FIG. 1*a* depicts a master instant lottery ticket in a master language (English) that may be used with the game systems and methods according to an exemplary embodiment of the present invention.
Figure 1B:
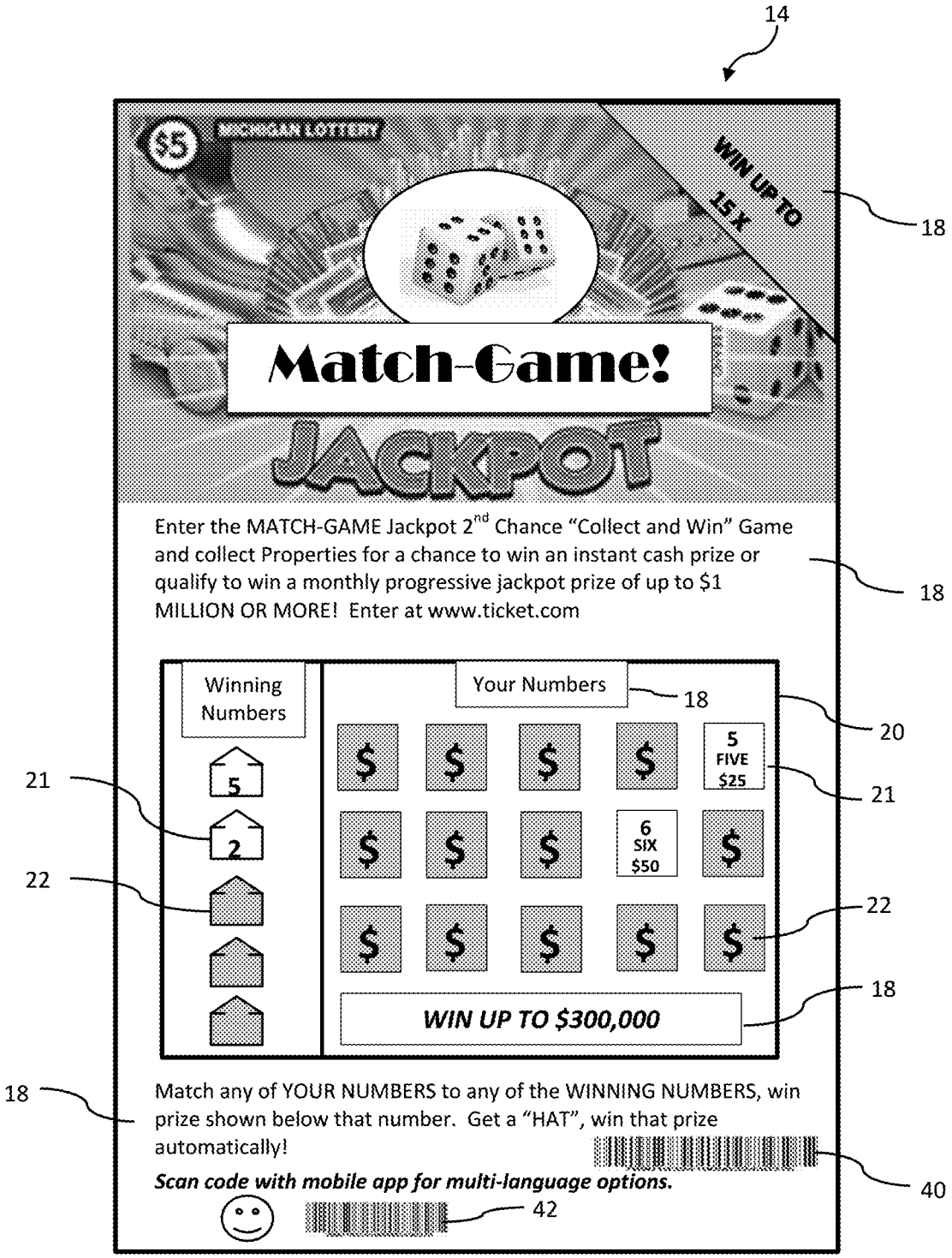
FIG. 1*b* depicts an alternate embodiment of an English-language master instant lottery ticket.

Referring to FIGS. 1*a* and 1*b*, an exemplary master instant lottery ticket 14 ("master ticket") is depicted. The master ticket 14 includes game instruction graphics and indicia 18 printed in a master language, such as English. Such indicia 18 explains to a player in the master language how to play the game embodied on the master ticket 14, as well as what constitutes a winning ticket and the prize amounts. The game instruction indicia 18 may be considered as "static" indicia in that, for a given game, it does not change from one ticket to the other.

The master tickets 14 may be printed paper tickets, or may be electronically simulated tickets 14 that are transmitted to and played by the player via an application running on a smart device 36 (FIG. 2), such as a mobile phone, tablet, computer, etc.

Still referring to FIGS. 1*a* and 1 *b*, and as is well-known to players of instant scratch-off lottery tickets, each master ticket 14 includes a game play area 20 wherein game play indicia 21 is provided and covered by a scratch-off coating (SOC) layer 22. In order to reveal the winning or losing status of the ticket 14, the player removes the coating 22 to uncover the underlying game play indicia 21. Thus, the game play indicia 21 may be considered as "variable" indicia in that it changes from one ticket 14 to another. In the embodiment depicted in the game of the master tickets 14 in FIGS. 1*a* and 1 *b*, the player is presented with a series (5) of "Winning Numbers" in the left-hand side of the game play area 20 covered by the SOC layer 22. A matrix of "Your Numbers" is provided in the right-had side of the game player area 20. The master language instructions 18 convey to the player that a match of any of the "Your Numbers" with any of the "Winning Numbers" wins the prize show below the number, as well as other prize potentials. Additional game instruction indicia 18 instructs the player on how to enter a second-chance game.

For each master ticket 14, one or more corresponding digital lottery tickets 24 (FIGS. 2 and 3) is generated and saved in a file 32, 34 associated with the master ticket 14 and accessible by the game server 38. Each of these digital lottery tickets 24 provides a digital image of a foreign-language counterpart to the master ticket 14 that includes the game instruction indicia 18 in a foreign language 26. For example, the master ticket 14 may be printed with the instruction indicia 18 in English (FIGS. 1*a* and 1*b*), and four corresponding digital lottery tickets 24 may be generated and stored in respective files, wherein the digital tickets 24 are in Spanish (FIG. 2), French, German, and Italian.

As mentioned above, the term "master language" in used herein to refer to the language of the primary printed or electronic ticket master ticket, and is not limited to any particular language. The term "foreign language" is used herein to refer to any language that is different than the master language.

Figure 2:
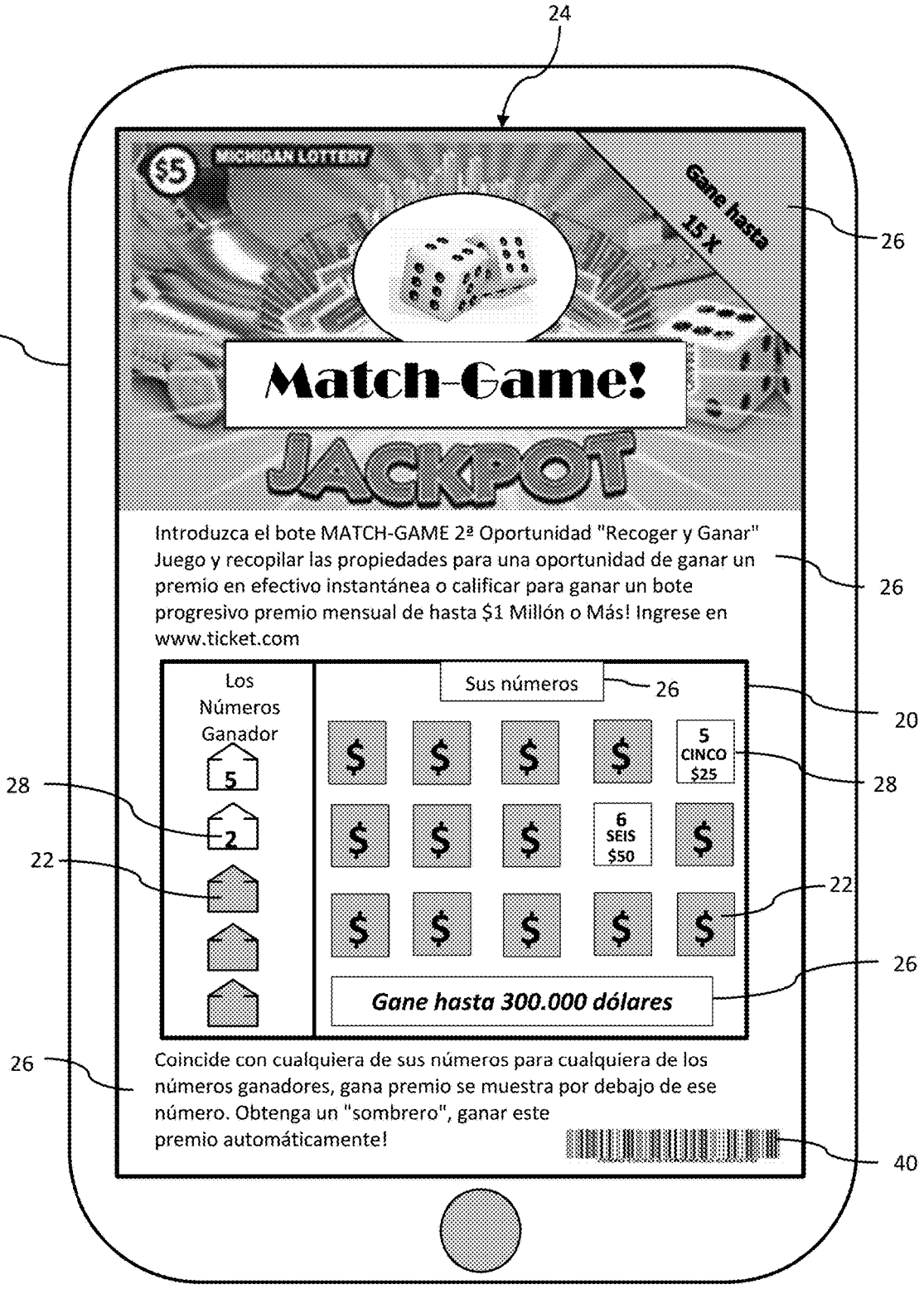
FIG. 2 depicts an image of a corresponding digital lottery ticket in a foreign language (Spanish) on a user's mobile smart device.

Each master ticket 14 includes a ticket-specific code 16 printed thereon, such as a scannable barcode (as depicted in the figures) or alpha-numeric code. The ticket-specific code is linked to the stored file 32, 34 of digital lottery tickets 24 associated with the master ticket 14 and accessible by the game server 38. Once the code 16 is scanned (or otherwise entered by the player into their smart device 36), transmitted by the player via their smart device 36, and received by the game server 38, the foreign-language digital lottery ticket 24 selected by the player via an option presented by the application running on the smart device 36 is retrieved by the game serve 38 and transmitted to the smart device 36, where the digital lottery ticket 24 is displayed as depicted in FIG. 2.

As depicted in FIGS. 1*a* and 1 *b*, the game play indicia 21 on the master ticket 14 may also include indicia in the master language, such as the words "five" and "six" as depicted in the figures. In such embodiments, it may be desirable that the digital lottery tickets 24 also provide such game play indicia 21 as foreign-language game play indicia 28, as depicted in FIG. 2.

Generally, conventional instant lottery tickets include a validation code 40 printed thereon, which may also be covered by a SOC layer 22, that links the ticket to a validation file 32 contained in the central server 38 (or otherwise accessible by the central server 38). Those skilled in the art appreciate that the validation file 32 contains ticket-specific information for validation and pay-out on the master ticket 14. In certain embodiments of the present system 10 and method 100, as depicted in FIG. 1*a*, the validation code 40 may also function as the ticket-specific code 16, wherein the digital lottery tickets 24 may be stored in the validation file 32 and accessed by the central server 38 upon receipt of the validation code 40 from the player's smart device 36.

However, in certain embodiments, it may not be desirable for security reasons to have the validation file 32 accessible for purposes of the foreign-language options described herein. FIG. 1*b* depicts an embodiment wherein the ticket-specific code 16 on each master ticket is a separate code 42 from the validation code 40. Referring to right-hand side of the central server 38 in FIG. 3, the separate codes 42 are linked to the digital lottery tickets 24 stored in respective ticket files 34 separate from the validation files 32.

The digital lottery ticket 24 depicted in FIG. 2 includes the validation code 40. With this optional configuration, the player is able to present either of the master ticket 14 or the digital lottery ticket 24 for validation and redemption of a winning game play.

The digital lottery tickets 24 may be presented as non-interactive static images on the player's smart device 36. For example, the image may simply present a "picture" of the ticket in the foreign language without the option or ability for the player to interact with or change the image.

However, in an alternate embodiment, the digital lottery tickets 24 may be presented as interactive images on the player's smart device 36, wherein the app on the smart device is configured to allow the player to simulate play of the digital lottery ticket 24 on their smart device 36, for example by simulating removal of the scratch-off coating from the foreign-language game play indicia 28 to reveal the winning or losing status of the ticket 24. Thus, in this embodiment, the player can actually play the game embodied by the master ticket 14 on their smart device 36 using the foreign language digital lottery ticket 24 without subsequent interaction with the master ticket 14.

The system 10 and method 100 also contemplate that each master ticket 14 is specifically configured to include an easily recognized symbol 44 printed thereon that indicates to players that one or more of the foreign language digital lottery tickets 24 is available for the master ticket 14. For example, such symbol 44 may be a multi-national caricature, similar to the Olympic game characters and mascots, or any other suitable indicia (including words and/or graphics).

Figure 3:
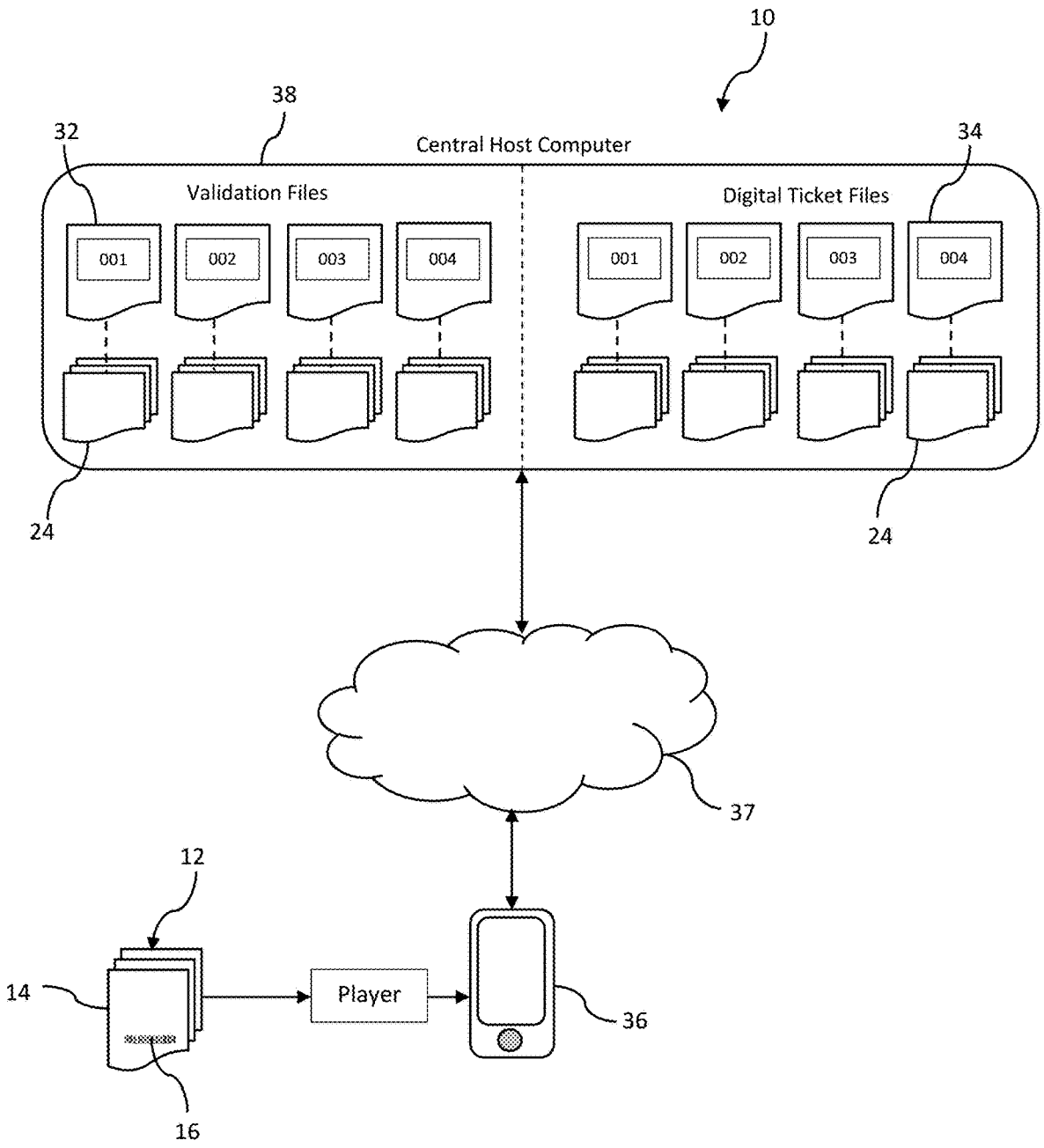
FIG. 3 is a block diagram of a system component configuration according to an embodiment of the invention.

FIG. 3 depicts the player's smart device 36 in communication with the central (host) server 38 via any suitable communications network 37. The network 37 can be any type of communications network, such as a local area network (e.g. intranet), wide area network (e.g. Internet), or some combination thereof. The network can also include a direct connection between a player mobile device 36 and the host server 38. In general, communication between the host server 38 and player mobile device 36 can be carried via a network interface using any type of wired and/or wireless connection, using a variety of communication protocols (e.g. TCP/IP, HTTP, SMTP, FTP), encodings or formats (e.g. HTML, XML, JSON), and/or protection schemes (e.g. VPN, secure HTTP, SSL).

It should be appreciated that the host server 38 can include a network interface for providing communications over the network 37. A network interface can include any suitable components for interfacing with one more networks, including for example, transmitters, receivers, ports, controllers, antennas, or other suitable components.

The host server 38 can be any computing device and can include one or more processors and one or more computer-readable media. The computer-readable media can store instructions which cause the processor to perform the operations described herein, as well as other functions related to conduct of the overall game for the lottery authority.

The player's smart device 36 can be any portable computing device that can be used by a player to interface with the host server 38. For instance, the device 36 can be a wireless device, a personal digital assistant (PDA), portable gaming device, cellular phone, smart phone, tablet, navigation system, handheld GPS system, wearable computing device, a display having one or more processors, or other such device. In short, the player's smart device 36 can be any computer-device or system that can execute a gaming module to allow a player to interact with the host computer 38 as described herein.

The technology discussed herein makes reference to servers, computers, databases, software applications, and other computer-based systems, as well as actions taken and information sent to and from such systems. One of ordinary skill in the art will recognize that the inherent flexibility of computer-based systems allows for a great variety of possible configurations, combinations, and divisions of tasks and functionality between and among components. For instance, server processes discussed herein may be implemented using a single server or multiple servers working in combination. Databases and applications may be implemented on a single system or distributed across multiple systems. Distributed components may operate sequentially or in parallel.

Figure 4:
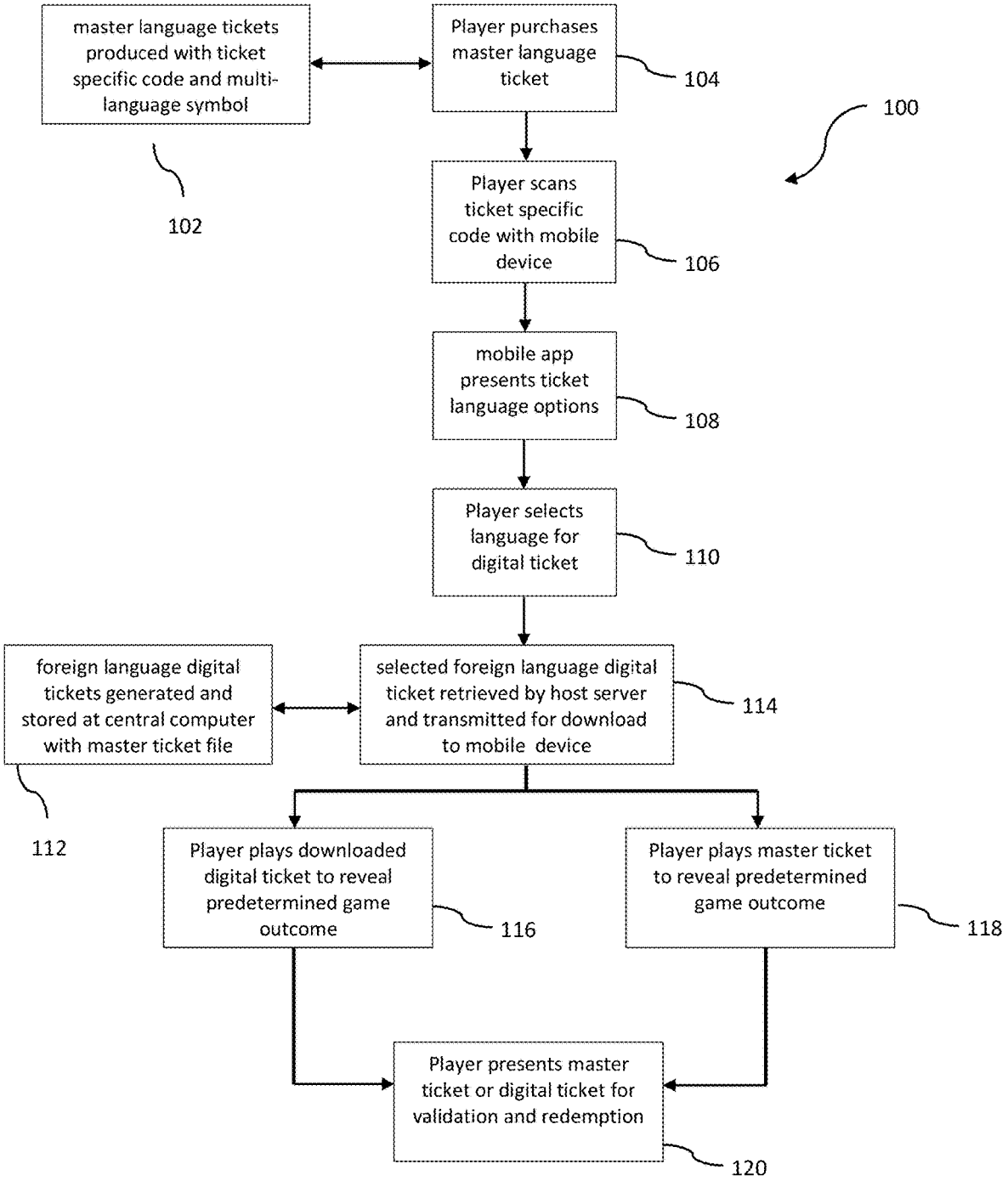
FIG. 4 is a flow diagram according to an embodiment of the invention.

FIG. 4 depicts an embodiment of method 100, aspects of which are discussed above. At step 102, the master language tickets 14 are produced with the ticket-specific code 16 and multi-language enabled symbol 44 provided thereon.

At step 104, the player purchases one or more of the master tickets 14 (paper or electronic).

At step 106, the player scans or otherwise enters the ticket-specific code 16 from the master ticket 14 into their smart device 36 via the application running on their smart device 36.

At step 108, via the application running on the smart device 36, the player is present with the foreign-language options available as digital lottery tickets 24 corresponding to the master ticket 14.

At step 110, the player selects one or more of the foreign-language options.

Step 112 depicts that the various foreign-language digital lottery tickets 24 are generated and stored in a ticket-specific file at the host server 38 (or at a location accessible by the server 38).

At step 114, upon receipt of the ticket-specific code 16 from the player's smart device 36, the host server retrieves the digital lottery ticket 24 corresponding to the selected foreign language and transmits the ticket 24 for download to the player's smart device 36.

Step 116 depicts that the downloaded digital lottery ticket 24 is interactive and allows the player to actually play the ticket 24 on their smart device 36 to determine the winning or losing status of the master ticket 14.

Step 118 depicts that the downloaded digital lottery ticket 24 is static, wherein the player, with the aid of the foreign language game instruction indicia 26, plays the master ticket 14 to determine the winning and losing status of the master ticket 14.

Step 120 depicts that the player presents the master ticket 14 for validation and redemption of a winning master ticket 14, or presents the corresponding digital lottery ticket 24 if the validation code 40 is provided on the digital ticket 24.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. An instant lottery ticket game system, comprising:

a set of master instant lottery tickets comprising instruction indicia printed in a master language, each of the master instant lottery tickets comprising a game play area with game play indicia that indicates a winning or losing status of the master instant lottery ticket;

each of the master instant lottery tickets further comprising a ticket-specific code printed thereon;

for each of the master instant lottery tickets, one or more digital lottery tickets saved in a file associated with the instant lottery ticket, each of the digital lottery tickets comprising a digital image of the master instant lottery ticket with at least the instruction indicia in a foreign language;

the ticket-specific code on each of the master instant lottery tickets linked to the file associated with the master instant lottery ticket;

a game server, the game server in communication with the files and configured for communication with a player's smart device via a computer application downloaded to the player's smart device; and wherein, via the application on their smart device, the player enters the ticket-specific code from the master instant lottery ticket and is presented with an option to receive one or more of the digital lottery tickets in the language selected by the player transmitted to their smart device.

2. The instant lottery ticket game system as in claim 1, wherein the game play indicia on the master instant lottery tickets is in the master language, the corresponding digital lottery tickets also comprising the game play indicia in the foreign language.

3. The instant lottery ticket game system as in claim 1, wherein the ticket-specific code on each of the master instant lottery tickets is a validation code that is liked to a validation file associated with the master instant lottery ticket, the validation file containing ticket-specific information for validation and pay-out on the master instant lottery ticket, the digital lottery tickets associated with the master instant lottery icket saved in the validation file.

4. The instant lottery ticket game system as in claim 1, wherein the digital lottery tickets are presented as non-interactive static images on the player's smart device.

5. The instant lottery ticket game system as in claim 1, wherein the digital lottery tickets are presented as interactive images on the player's smart device, the application configured to allow the player to simulate play of the digital lottery ticket on their smart device.

6. The instant lottery ticket game system as in claim 1, wherein the ticket-specific code on each of the master instant lottery tickets comprises a scannable code format.

7. The instant lottery ticket game system as in claim 1, wherein each of the master instant lottery tickets comprises a symbol printed thereon that indicates to players that one or more of the foreign language digital lottery tickets is available for the master instant lottery ticket.

8. An instant lottery ticket game system, comprising:

a set of master instant lottery tickets comprising instruction indicia printed in a master language;

each of the master instant lottery tickets further comprising a ticket-specific code printed thereon;

for each of the master instant lottery tickets, one or more corresponding digital lottery tickets saved in a file associated with the instant lottery ticket, each of the digital lottery tickets comprising the instruction indicia in a foreign language;

the ticket-specific code on each of the master instant lottery tickets linked to the file associated with the master instant lottery ticket;

a game server, the game server in communication with the files and configured for communication with a player's smart device via a computer application downloaded to the player's smart device;

wherein, via the application on their smart device, the player enters the ticket-specific code from the master instant lottery ticket and is presented with an option to receive one or more of the digital lottery tickets in the language selected by the player transmitted to their smart device; and wherein each of the master instant lottery tickets further comprises a validation code that is linked to a validation file associated with the master instant lottery ticket, the validation file containing ticket-specific information for validation and pay-out on the master instant lottery ticket, the ticket-specific code on each of the master instant lottery tickets separate from the validation code and the digital lottery tickets stored separate from the validation file.

9. An instant lottery ticket game system, comprising:

a set of master instant lottery tickets comprising instruction indicia printed in a master language;

each of the master instant lottery tickets further comprising a ticket-specific code printed thereon;

for each of the master instant lottery tickets, one or more corresponding digital lottery tickets saved in a file associated with the instant lottery ticket, each of the digital lottery tickets comprising the instruction indicia in a foreign language;

the ticket-specific code on each of the master instant lottery tickets linked to the file associated with the master instant lottery ticket;

a game server, the game server in communication with the files and configured for communication with a player's smart device via a computer application downloaded to the player's smart device;

wherein, via the application on their smart device, the player enters the ticket-specific code from the master instant lottery ticket and is presented with an option to receive one or more of the digital lottery tickets in the language selected by the player transmitted to their smart device; and wherein each of the master instant lottery tickets further comprises a validation code that is linked to a validation file associated with the master instant lottery ticket, the validation file containing ticket-specific information for validation and pay-out on the master instant lottery ticket, each of the digital lottery tickets associated with the master instant lottery ticket containing the validation code as well, wherein the player is able to present either of the master instant lottery ticket or the digital lottery ticket for validation and redemption.

10. A method for providing multi-lingual capability to an instant lottery ticket game system, comprising:

producing a set of master instant lottery tickets having instruction indicia printed in a master language, each of the master instant lottery tickets also having a game play area with game play indicia that indicates a winning or losing status of the master instant lottery ticket;

on each of the master instant lottery tickets, printing a ticket-specific code thereon;

for each of the master instant lottery tickets, producing one or more digital lottery tickets as a digital image of the master instant lottery ticket with at least the instruction indicia in a foreign language, and saving the digital lottery tickets in a computer-accessible file;

the ticket-specific code on each of the master instant lottery tickets linked to the file that contains the digital lottery tickets associated with the master instant lottery ticket;

configuring a game server in communication with a player's smart via a computer application downloaded to the player's smart device, the game server in communication with the computer-accessible files; and wherein, upon the player entering the ticket-specific code from the master instant lottery ticket via the application on their smart device, the game server accesses the file associated with the master instant lottery ticket and transmits the digital lottery ticket in the language selected by the player to the player's smart device.

11. The method as in claim 10, wherein the game play indicia on the master instant lottery tickets is in the master language, and further comprising generating the digital lottery tickets with the game play indicia in the foreign language.

12. The method as in claim 10, wherein the ticket-specific code on each of the master instant lottery tickets is a validation code that is liked to stored validation file associated with the master instant lottery ticket, the validation file containing ticket-specific information for validation and pay-out on the master instant lottery ticket, the digital lottery tickets associated with the master instant lottery ticket saved in the validation file.

13. The method as in claim 10, wherein each of the master instant lottery tickets is produced with a validation code that is linked to a stored validation file associated with the master instant lottery ticket, the validation file containing ticket-specific information for validation and pay-out on the master instant lottery ticket, wherein the ticket-specific code on each of the master instant lottery tickets is separate from the validation code and the digital lottery tickets are stored separate from the validation file.

14. The method as in claim 10, wherein the digital lottery tickets are presented as non-interactive static images on the player's smart device.

15. The method as in claim 10, wherein the digital lottery tickets are presented as interactive images on the player's smart device, the application configured to allow the player to simulate play of the digital lottery ticket on their smart device.

16. The method as in claim 10, wherein the ticket-specific code on each of the master instant lottery tickets is generated as a scannable code format.

17. The method as in claim 10, wherein each of the master instant lottery tickets further is produced with a validation code that is linked to a stored validation file associated with the master instant lottery ticket, the validation file containing ticket-specific information for validation and pay-out on the master instant lottery ticket, each of the digital lottery tickets associated with the master instant lottery ticket generated with the validation code as well, wherein the player is able to present either of the master instant lottery ticket or the digital lottery ticket for validation and redemption.

18. The method as in claim 10, wherein each of the master instant lottery tickets is produced with a symbol printed thereon that indicates to players that one or more of the foreign language digital lottery tickets is available corresponding to the master instant lottery ticket.

* * * * *